United States Patent [19]

Williams

[11] 4,340,789

[45] Jul. 20, 1982

[54] CHAFF-FLARE TEST ADAPTER SWITCHING SYSTEM

[76] Inventor: Robert A. Williams, 2721 White Settlement Rd., Fort Worth, Tex. 76107

[21] Appl. No.: 30,364

[22] Filed: Apr. 16, 1979

[51] Int. Cl.[3] ..... H01H 19/58; H01H 21/78

[52] U.S. Cl. ..... 200/11 R; 200/11 D; 200/14

[58] Field of Search ..... 200/11 R, 11 D, 11 DA, 200/14, 157, 316

[56] References Cited

U.S. PATENT DOCUMENTS 3,013,231 12/1961 Meadows et al. ..... 200/11 D X
3,189,696 6/1965 Nuttall ..... 200/11 D
3,202,829 8/1965 Kawahara ..... 200/157 X
3,856,997 12/1974 Kilkes ..... 200/11 R X
3,863,079 1/1975 Calabrese ..... 200/37 A X

*Primary Examiner*—James R. Scott
*Attorney, Agent, or Firm*—Arthur F. Zobal

[57] ABSTRACT

A quick dialing switching system for an adapter employed for testing a chaff-flare firing system used in military aircraft. The adapter has a base which carries a plurality of contacts for engaging the contacts of the chaff-flare firing system. The switching system comprises two rotary switches each operated by its own rotatable knob for sequentially dialing the contacts of the adapter base to allow the contacts of the firing system to be tested.

6 Claims, 11 Drawing Figures

Fig. 8
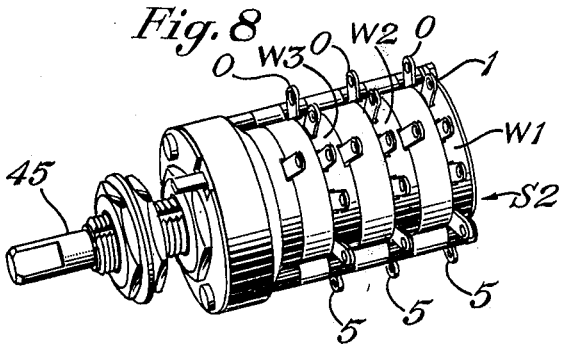
Fig. 4
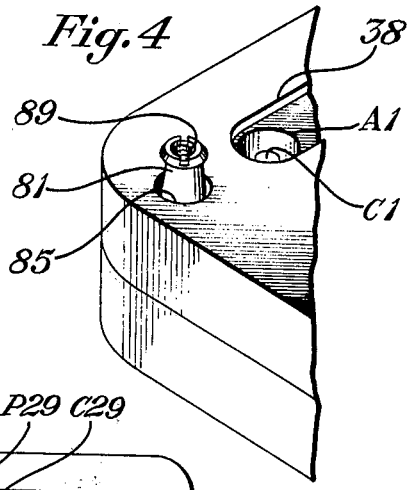
Fig. 3
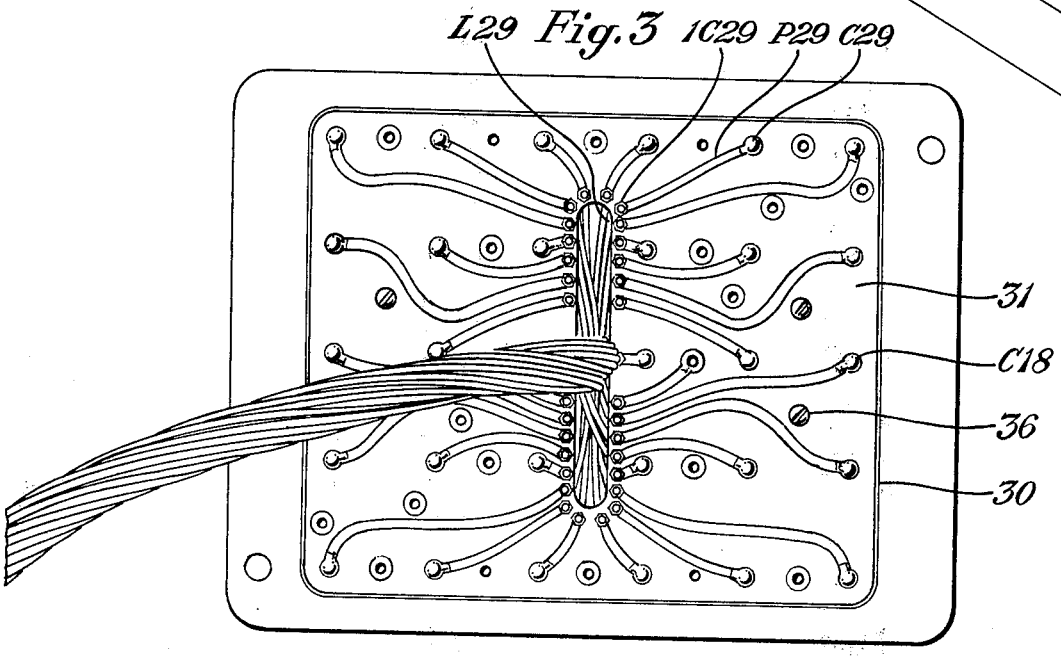
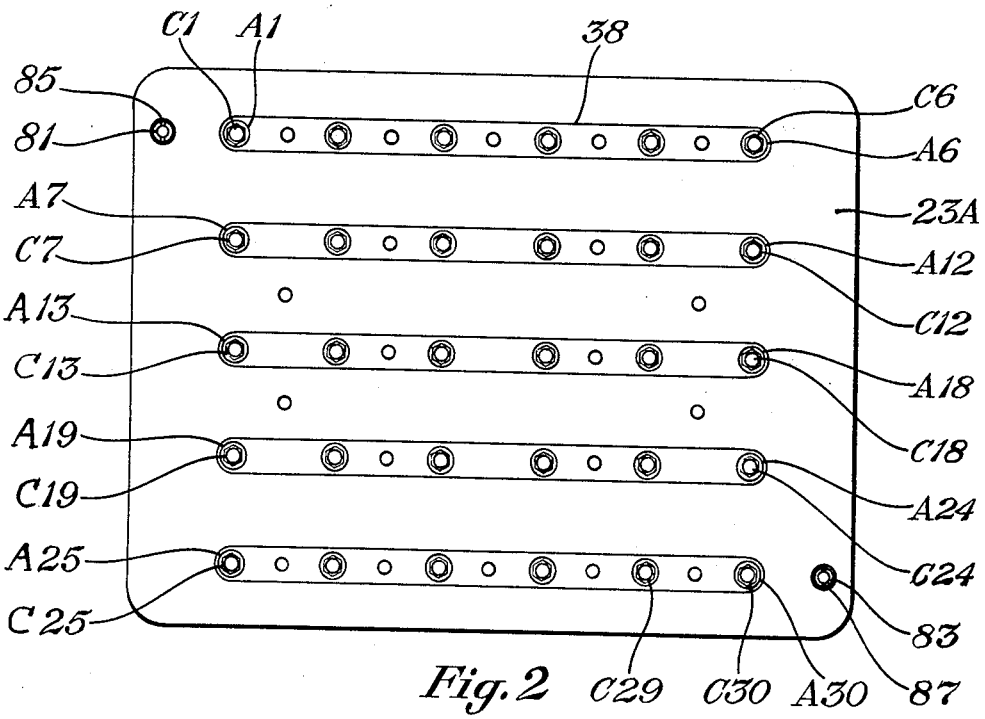
Fig. 2

CHAFF-FLARE TEST ADAPTER SWITCHING SYSTEM

BACKGROUND OF THE INVENTION

1. Field of the Invention

The present invention relates to a quick dialing switching system for an adapter used for testing a chaff-flare firing system.

2. Description of the Prior Art

Currently military aircraft employ chaff-flares which are fired to confuse enemy missiles. These devices are ejected from the plane by a system which is electrically actuated. The chaff-flares are loaded in a downward facing recess formed in the plane and which has a plurality of electrical contacts for providing actuating current. Prior to loading, the firing system and contacts must be tested to determine if sufficient current is obtainable when the firing system is on and if no current is present on the contacts when the firing system is off.

Devices are employed for carrying out these tests, however, testing of all of the contacts of the chaff-flare firing system with the prior devices is very time consuming.

SUMMARY OF THE INVENTION

It is an object of the present invention to provide a quick dialing switching system for an adapter for use for testing a chaff-flare firing system.

It is a further object of the present invention to provide a switching system comprising a rotary switch means operated by rotatable knob means for sequentially dialing the contacts of an adapter base to allow the contacts of a chaff-flare firing system to be tested.

It is another object of the present invention to provide a switching system comprising two rotary switches each operated by its own rotatable knob for sequentially dialing the contacts of an adapter base to allow the contacts of a chaff-flare firing system to be tested.

BRIEF DESCRIPTION OF THE DRAWINGS

FIG. 2 is a plan view of the contact side of the base of the adapter of FIG. 1 illustrating a plurality of electrical contacts.

FIG. 3 is an electrically insulated circuit board located within the base of the adapter of FIG. 1 and which carries the contacts shown in FIG. 2.

FIG. 4 illustrates in detail one of the two attaching members shown in FIG. 2.

FIG. 8 is a perspective view of a rotary switch employed in the switching system of the adapter of FIG. 1.

DESCRIPTION OF THE PREFERRED EMBODIMENT

Figures 1, 9, 10:
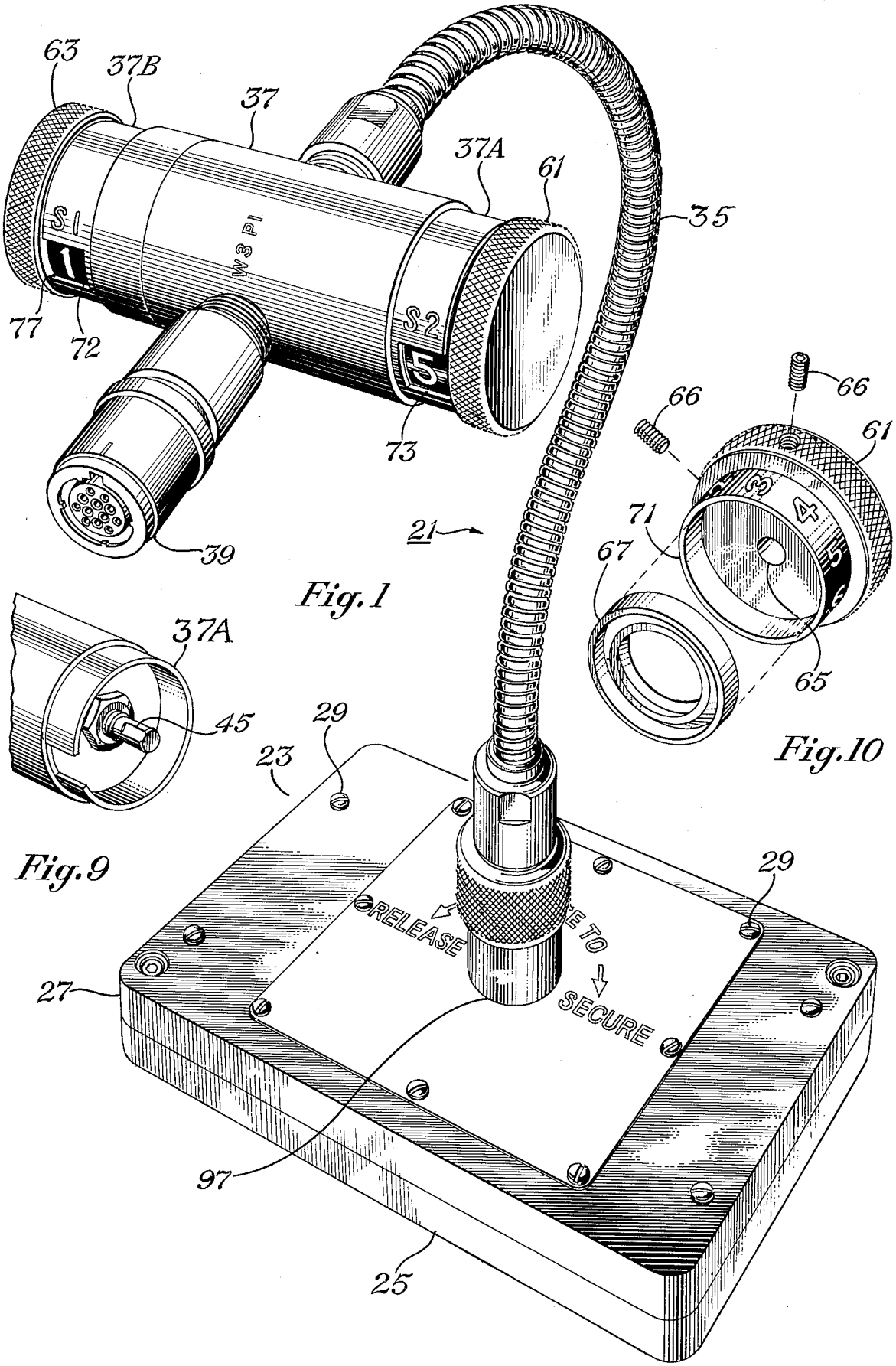
FIG. 1 is a perspective view of the adapter of the present invention.
FIG. 9 illustrates a portion of the switch of FIG. 8 located in its housing.
FIG. 10 illustrates one of the switching knobs of FIG. 1 in a disassembled position.
Figure 5:
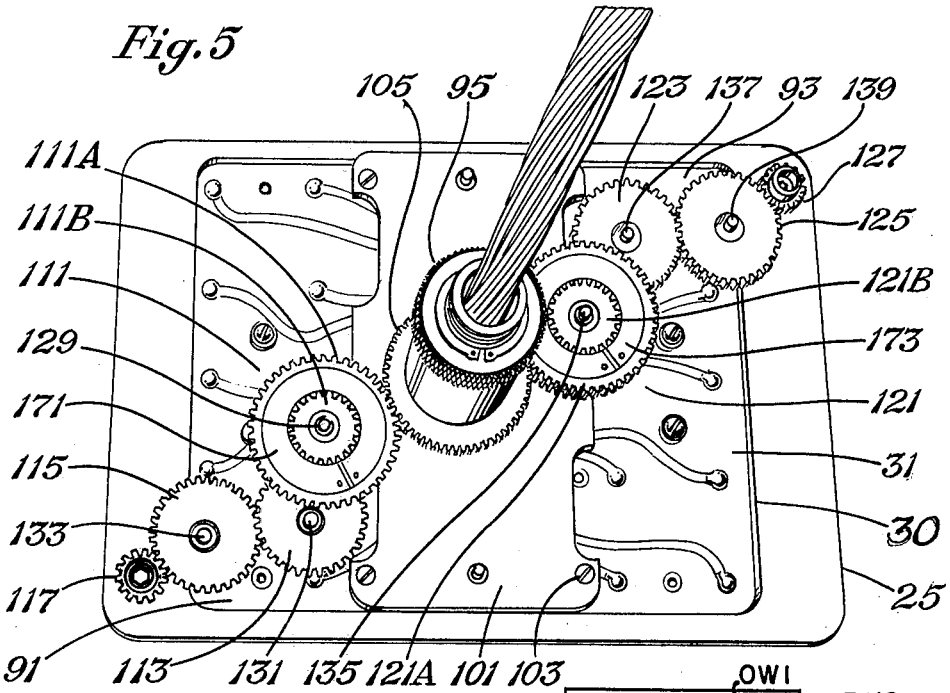
FIG. 5 illustrates the two drive means located in the base of the adapter of FIG. 1 employed for rotating the two attaching members for threading and unthreading purposes.

Referring now to FIGS. 1-3 of the drawings, the adapter of the present invention is identified at 21. It comprises a base 23 formed of two metal plates 25 and 27 which are secured together by bolts 29. Plate 25 has a cavity 30 for holding an electrically insulating circuit board 31 and plate 27 has a cavity (not shown) for receiving the gear drive mechanism of FIG. 5. The other side of the circuit board 31 has secured thereto 30 electrical contacts C1–C30 which are shown in FIG. 2. These contact extend through apertures A1–A30 respectively formed through base plate 25 when the circuit board is fitted into cavity 30. The circuit board is secured in the cavity 30 by bolts 36. As shown in FIG. 2, the apertures A1–A30 are large enough such that the contacts do not engage their walls. The apertures A1–A30 are formed in rows and open into grooves 38 formed in the surface of the contact side 23A of the base 23. The ends of the of contacts C1–C30 are spaced inward from the flat surface of the contact side 23A of the base 23 and inward from the inward surface of the grooves 38.

The contacts C1–C30 extend through the circuit board and on the side shown in FIG. 3, a printed circuit extends from each contact to the center where it is connected to an electrical lead. For example, printed circuit P29 extends from contact C29 to an inward contact IC29 which is connected to electrical lead L29. All of the leads extend in a bundle through a flexible conduit 35 to a housing 37 which houses the rotary switch S2 of FIG. 8. Each of the leads of the bundle except for the ground lead GL (See FIG. 11) and lead L30 from contact C30 is connected to one of the ten contacts of one of the three wafers W1–W3 of the switch S2.

Figure 11:
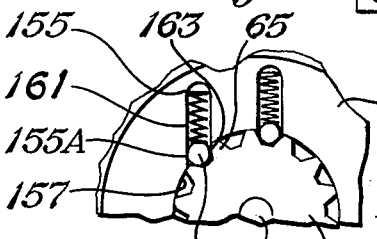
FIG. 11 is an electrical schematic diagram of the switching system employed in the adapter of FIG. 1.

Referring also to FIG. 11, the thirty contacts C1–C30 are identified as blocks 1–30 respectively and the ten contacts of each of the three wafers W1–W3 are identified as 0W1–9W1, 0W2–9W2, and 0W3–9W3 respectively. In FIG. 11, the printed circuits on the circuit board 31 are not illustrated. Leads L1–L9 are shown extending directly from blocks 1–9 to contacts 1W1–1W9 of wafer W1; leads L10–L19 are shown extending directly from blocks 10–19 to contacts 0W2–9W2 of wafer W2; and leads L20–L29 are shown extending directly from blocks 20–29 to contacts 0W3–9W3 of wafer W3. Contact 0W1 of wafer W1 has no fixed electrical lead connected thereto. Lead L30 extends from block 30 to contact 3S1 of a second rotary switch S1 located in the housing 37. Ground lead GL extends from block 31 (which identifies a ground connection) to contact 5I which is a female receptacle of an indicator connector 39. Lead 40 is connected from ground lead GL to female receptacle 2I of indicator 39.

The ten contacts 0W1–9W1, 0W2–9W2, and 0W3–9W3 of each of wafers W1, W2, W3 respectively of switch S2 are arranged in a circle of sequential engagement by a rotatable wiper contact associated with each wafer. In FIG. 11, the rotatable wiper contacts for the wafers W1, W2, W3 are identified at 41, 42, and 43 respectively. These wiper contacts are fixedly connected to a rotatable shaft 45 such that rotation of the shaft rotates all of the three wiper contacts 41–43 simultaneously. The wiper contacts 41–43 are located with respect to each such that they engage corresponding contacts of their wafers at the same time. For example, when wiper contact 41 engages wafer contact 6W1, wiper contacts 42 and 43 engage wafer contacts 6W2 and 6W3 respectively. In FIG. 11, the rotary shaft 45 is represented by dotted line 45.

Wiper contacts 41, 42, and 43 are connected by leads 51, 52 and 53 respectively to contacts 0S1, 1S1, and 2S1 of rotary switch S1. Contacts 0S1, 1S1, 2S1, and 3S1 are carried by a single wafer and are arranged in a circle for sequential engagement by a rotatable wiper contact 55 when it is rotated by a rotatable shaft represented by dotted line 57. Wiper contact 55 is connected by way of leads 59 and 60 to female receptacles 1I and 4I of connector 39.

Shafts 45 and 57 are rotated separately by knobs 61 and 63 extending out of opposite ends of housing 37. The shafts are located in axial apertures formed in the knobs and fixedly held to the knobs by set screws. In FIG. 10, the axial aperture of knob 61 is identified at 65 and the set screws which fixedly hold the knob to the shaft 45 are identified at 66. Member 67 is an annular plastic seal which fits within rim 71 of the knob 61 to form a water tight seal between the knob 61 and the inside of housing 37. A similar annular seal (not shown) is located within the rim 72 of knob 63.

The rim 71 of knob 61 has numbers 1–10 formed at equally spaced positions around its outside for viewing through a window 73 formed through the end 37A of housing 37. The knob 61 can be rotated 360° to present any of its ten numbers for viewing through the window 73. Knob 61 is connected to shaft 45 such that when either of its number 0–9 on its rim 71 appears through window 73, the wiper contacts 41–43 engage the corresponding wafer contacts of switch S2. For example, if the number 6 appears in window 73, the wiper contacts 41–43 will engage wafer contacts 6W1, 6W2, and 6W3.

The rim 72 of knob 63 has spaced numbers 0–3 formed around its outside within an arc of about 45° for viewing through window 77 formed through end 37B of housing 37. Stops (not shown) are formed on rim 72 and within the housing end 37B such that knob 63 may be rotated only over an angular path (about 45°) sufficient to present only its numbers 0–3 for viewing through window 77. Knob 63 is connected to shaft 57 such that when either of its number 0–3 on its rim 72 appears through window 77, the wiper contact 55 will engage the corresponding wafer contact of switch S1. For example, if number 1 appears through window 77, contact 55 will engage wafer contact 1S1.

The knobs 61 and 63, their numbers on their rims, and the two rotary switches S1 and S2 connected as shown in FIG. 11, allows the operator to rapidly dial any of the contacts C1–C30 for connection to the female receptacles 1I or 4I of connector 39 for tests purposes. For example, by dialing number 6 with knob 61 and number 2 with knob 63, contacts C26 (block 26 of FIG. 11) will be connected to female receptacle 1I and 4I of connector 39. In this position of the knob 61 and 63, wiper contacts 41, 42, and 43 will engage wafer contacts 6W1, 6W2, and 6W3, however, wiper contact 55 will engage wafer contact 2S1 only. Thus contact C26 will be contacted to female receptacles 1I and 4I by way of lead L26 wiper contact 43, lead 53, wafer contact 2S1, wiper contact 55, and leads 59 and 60. If the number 3 is dialed by knob 63 and the number 0 is dialed by knob 61, contact C30 will be connected to female receptacles 1I and 4I by way of lead L30, wafer contact 3S1, wiper contact 55, and leads 59 and 60.

Thus wafer contacts 0W1–9W1, 0W2–9W2, and 0W3–9W3 represent the decimal digits 0–9 respectively and contacts 0S1–3S1 represent the decimal digits 0–3 weighted by a factor of 10. By dialing with knob 63 any of the contacts 0S1–3S1 and either of the decimal digits 0–9 with knob 61, any of the contacts C1–C30 can be connected to the indicator for test purposes.

The quick dialing arrangement as described is very useful for testing all of the contacts of the chaff-flare firing mechanism particularly in cold weather when the operator is required to wear gloves. The testing operations are carried as follows. An indicator (not shown) is connected to either of receptacles 1I or 4I and to either of receptacles 2I or 5I. Prior to loading of the chaff-flares, the base 23 of the adapter 21 with its contact side 23A forward is fitted into the recess formed in the aircraft to receive the chaff-flares. A quick connect-disconnect apparatus, which will be described subsequently, is operated to connect the base 23 to the housing of the firing system. When the base 23 is properly connected to the housing of the firing system, its contact side 23A will engage the housing of the firing system and its thirty contacts C1–C30 will engage the thirty contacts respectively of the firing system. Engagement of the base 23 with the housing of the firing system forms the ground connection which is identified as block 31 in FIG. 11. With the firing system on, the knobs 61 and 63 will be operated to sequentially connect each of the contacts C1–C30 and hence each of the thirty contacts of the firing system to the indicator to determine whether there is sufficient firing current on the contacts. The sequential tests are then repeated with the firing system off to insure that there is no current on the contacts of the firing system when it is in the off condition. The quick connect-disconnect mechanism then is operated to release the base and remove it from the recess whereby the chaff-flares may be loaded in place.

Referring now to FIGS. 2,4, and 5–7, the quick connect-disconnect apparatus will be described. This apparatus comprises two hollow members 81 and 82 extending through apertures 85 and 87 formed thru plate 25 and beyond the contact side 23A of base 23. Members 81 and 83 are rotatably supported by the base and have internal threads 89 whereby they may be threaded to two threaded male members extending from the housing of the firing system. The members 81 and 83 may be rotated in opposite directions by two drive means 91 and 93 and a rotatable knob 95. The drive means 91 and 93 and the lower portion of the knob 95 are located between plates 25 and 27 in a cavity formed in plate 27 and the upper portion of knob 95 extends through an aperture 97 formed through plate 27 whereby it may be rotated by hand. Each drive means 91 and 93 is constructed such that if its associated threaded member 81 or 83 is threaded to a tightened position before the other, it will slip allowing the knob 95 to continue to be rotated for threading the other threaded member to a tightened position. During unthreading, neither drive means 91 or 93 will slip.

Knob 95 has its lower end 95A rotatably located in an aperture (not shown) formed through a plate 101 which is secured to plate 25 by bolts 103. An electrically insulated sheet (not shown) is located between plate 101 and the circuit board 31. Fixedly attached to the lower end 95A of knob 95 above the plate 101 is a gear 105 which drives drive means 91 and 93 when the knob 95 is rotated. Drive means 91 comprises gear means 111 and gears 113, 115 and 117, the later of which is attached to threaded member 81. Drive means 93 comprises gear means 121 and gears 123, 125, and 127, the later of which is attached to threaded member 83.

Figure 6:
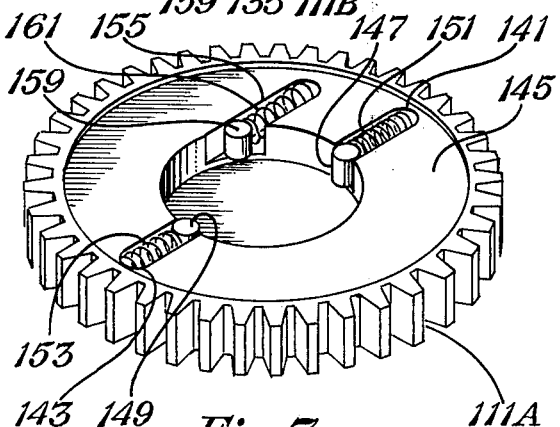
FIG. 6 illustrates the slip and locking mechanism of one of the drive means of FIG. 5.
Figure 7:
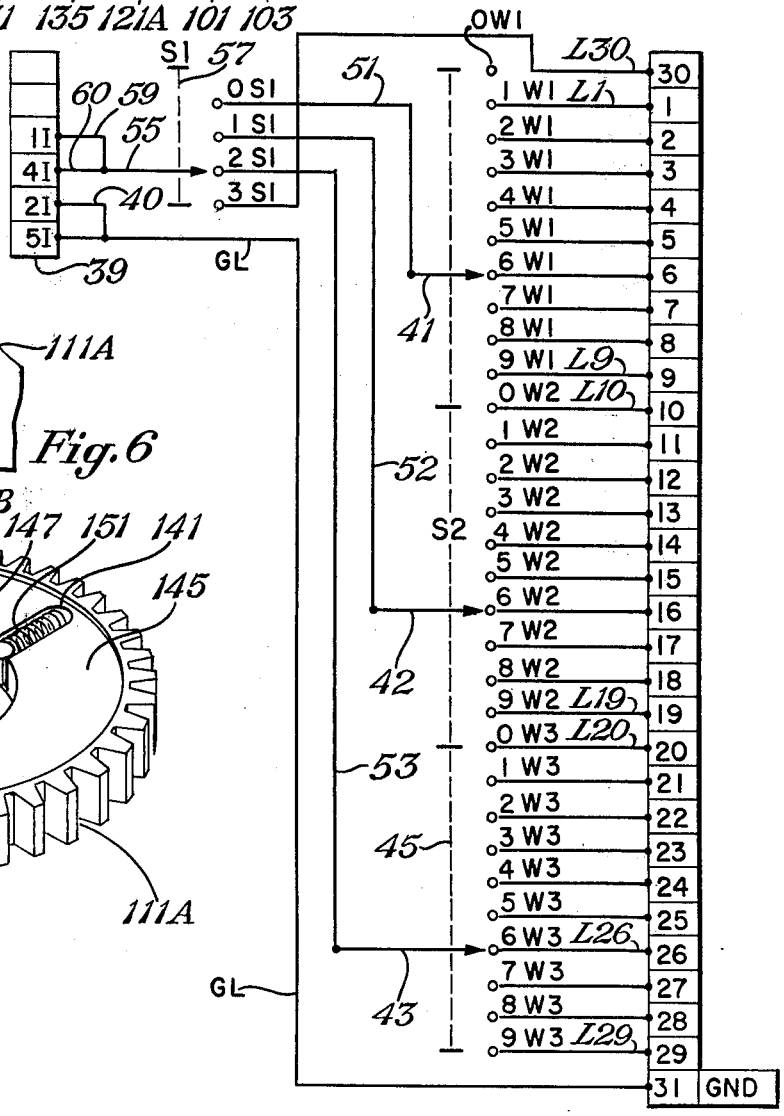
FIG. 7 is a perspective view of the complete outer gear of FIG. 6.

Referring also to FIGS. 6 and 7, gear means 111 comprises an outer gear 111A whose teeth mesh with those of gear 105, and an inner concentric gear 111B. The axial dimension of gear 111B is greater than that of gear 111A and its lower portion extends below gear 111A whereby its teeth mesh with the teeth of gear 113. The teeth of gear 113 also mesh with the teeth of gear 115 whose teeth also mesh with those of gear 117. Gears 111B, 113, and 115, are supported for rotation by pins 129, 131, and 133 respectively which are secured to plate 25.

Similarly, gear means 121 comprises an outer gear 121A, whose teeth mesh with those of gear 105, and an inner concentric gear 121B. The axial dimension of gear 121B is greater than that of gear 121A and its lower portion extends below gear 121A whereby its teeth mesh with the teeth of gear 123. The teeth of gear 123 also mesh with the teeth of gear 125 whose teeth also mesh with those of gear 127. Gears 121B, 123, and 125 are supported for rotation by pins 135, 137, and 139 respectively which are secured to plate 25.

In operation, when knob 95 and hence gear 105 are rotated clockwise, the gears are driven to rotate gears 117 and 127 and their threaded member 81 and 83 clockwise whereby they may be threaded to the two threaded male members of the firing system for connecting the base thereto. In the connected position, the contacts C1–C30 separately engage the thirty contacts of the firing system. Rotation of the knob 95 counterclockwise rotates gears 117 and 127 and hence threaded members 81 and 83 counterclockwise for unthreading purposes for releasing the base 23 from the firing system.

During the connecting process, if member 81 is threaded to a tightened position before member 83, gear 111A will slip relative to gear 111B thereby allowing knob 95 to continue to be rotated whereby member 83 may be threaded to a tightened position also. Similarly, if member 83 is threaded to a tightened position before member 81, gear 121A will slip relative to the gear 121B thereby allowing knob 95 to continue to be rotated whereby member 81 may be threaded to a tightened position. During the unthreading process, neither of gears 111A or 121A will slip relative to their inner gears 111B and 121B.

Since gear means 111 and 121 are identical, only gear means 111 will be described in detail. As seen in FIGS. 6 and 7, outer gear 111A has two opposite radial slots 141 and 143 formed in side 145. Slidably located in slots 141 and 143 are cylindrical pins 147 and 149 which are urged inward by springs 151 and 153. A third slot 155 parallel to slot 141 is formed in side 145 of gear 111A at a point nearly tangent to the inner wall 157 of gear 111A. Slidably located in slot 155 is a cylindrical pin 159 which is urged inward by spring 161. The diameters of pins 147, 149, and 159 are such that the pins will fit partially in the space between adjacent teeth of gear 111B when the spaces are aligned with slots 141, 143, and 155 as shown in FIG. 6. During the threading operation, knob 95 and hence gear 105 will be rotated clockwise whereby gear 111A will be rotated counterclockwise. As long as there is no large amount of force between gears 111A and 111B, springs 151 and 153 will hold pins 147 and 149 partially in the space between adjacent teeth of the gear 111B and partially in their slots 141 and 143 as shown in FIGS. 6 and 7 whereby gear 111B also will be rotated counterclockwise thereby driving gears 113, 115 and 117 in a manner to thread member 81 to the threaded male member to the firing system. When member 81 is threaded to a tightened position, gears 117, 113, and 111B will become stationary and as additional counterclockwise force is applied to gear 111A, the pins 147, 149, and 159 will follow the surfaces of the next teeth of gear 111B outward into their slots 141, 143, and 155 respectively. Thus the pins 147, 149, and 159 will be moved completely into their slots whereby gear 111A may rotate or slip relative to gear 111B. Upon continued rotation of gear 111A, the pins will be moved inward by their springs into the next spaces between the teeth of gear 111B and then outward into their slots, etc., allowing gear 111A to rotate relative to gear 111B. Gears 121A and 121B operate in the same manner. This feature allows both members 81 and 83 to be threaded to a tightened position. For example if member 81 is threaded to a tightened position before member 83, gear 111A will begin to slip allowing knob 95 to continue to be rotated to thread member 83 to a tightened position.

When knob 95 is rotated counterclockwise to unthread members 81 and 83, neither of gears 111A nor 121A will slip. This insures that members 81 and 83 will be unthreaded from tightened positions. Referring again to FIG. 6, when knob 95 is rotated counterclockwise, gear 111A will be rotated clockwise. Assume that pin 159 is in the space between the two gear teeth as shown. Upon the application of a clockwise force to gear 111A the forces between gears 111A and 111B will hold or lock pin 159 between the wall portion 155A of slot 155 and the opposite surface 163 of tooth 165. Thus pin 159 will not be moved into slot 155 whereby gear 111A will not slip relative to gear 111B if a clockwise rotational force is applied to gear 111A. Thus gear 111B will rotate clockwise with gear 111A to unthread member 81 regardless of how tight it is threaded to the male threaded member of the firing system. Due to the radial positions of slots 141 and 143, their pins 147 and 149 do not act to lock gear 111B to gear 111A upon the application of a clockwise force to gear 111A. Gears 121A and 121B operate in the same manner. Cover plates 171 and 173 are secured to the gears 111A and 121A to hold their pins and springs in their slots.

Thus as can be understood, the quick connect-disconnect apparatus allows the base 23 of the adapter to be rapidly and effectively connected to the firing system for test purposes by simply rotating the knob 95 in a clockwise direction. The base may be rapidly disconnected by rotating the knob 95 in a counterclockwise direction.

The base 23 is capable of holding two additional gears drive means and two additional threaded members if required.

In one embodiment, the rotary switch S2 is of the type manufactured by Grayhill, Inc., La Grange, Ill. 60525 and shown in their Engineering Catalog G-374A, pages 38–44, copyright 1974.

The drive means 91 and 93 may be modified to employ belts for rotating members 81 and 83 instead of the gear trains shown and described. In this modification, gears 105, 113, 115, 123, and 125 will be eliminated. The lower end 95A of knob 95 will have a smaller diameter and gear 111B will be modified to be annular in shape having an inside diameter sufficient to receive the lower end 95A of knob 95. Gear 111B will be fixedly connected around end portion 95A at one level with gear 111A located around gear 111B. Gear 111A will have the same slots, pins, and springs as shown in FIGS. 6 and 7. A flexible belt with inner teeth will extend around gears 111A and 117 for driving gear 117 and hence member 81 when knob 95 is rotated. Gear 121B also will be modified to be annular in shape having an inside diameter sufficient to receive the lower end 95A of knob 95. Gear 121B will be fixedly connected around end portion 95A at a level different from that of gear 111B. Gear 121A will be located around gear 121B and will have the same slots, pins, and springs as gear 111A as shown in FIGS. 6 and 7. A flexible belt with inner teeth will extend around gears 121A and 127 for driving gear 127 and hence member 83 when knob 95 is rotated.

When knob 95 is rotated clockwise, modified gears 111B and 121B will be directly rotated clockwise which in turn will rotate clockwise gears 111A and 121A, their belts, and gears 117 and 127 and hence members 81 and 83. Counterclockwise rotation of knob 95 results in counterclockwise rotation of gears 111B and 121B, gears 111A and 121A, their belts, gears 117 and 127 and hence members 81 and 83. During the threading operations, pins 147 and 149 will biased by their springs partially into the spaces between adjacent teeth of 111B and 121B which will cause gears 111A and 121A to be rotated clockwise with gears 111B and 121B respectively. If member 81 becomes tightened before member 83, gear 111B will begin to slip or rotate relative to gear 111A thereby allowing knob 95 to continue to be rotated to thread member 83 to a tightened position. Similarly, if member 83 becomes tightened before member 81, gear 121B will begin to slip or rotate relative to gear 121A thereby allowing knob 95 to continue to be rotated to thread member 81 to a tightened position.

When knob 95 is rotated in a counterclockwise direction to unthread members 81 and 83, pins 159 of gears 111A and 121A will lock gears 111A and 121A to gears 111B and 121B respectively preventing slipage between gears 111A and 111B and 121A and 121B.

In the event that the chaff-flare firing system has ten or less contacts, a corresponding number of contacts will be carried by the base 23 and located to engage the firing system contacts when the base 23 is locked in place for test purposes. Only one of the wafers W1–W3 of switch S2 will be employed and switch S1 will be eliminated. For example, assume that the firing system has only ten contacts. Base 23 may be modified to carry only contacts C1–C9 and C30 appropriately located to engage the ten contacts of the firing system. Lead L30 will be connected to contact 0W1. Contacts 0W2–9W2 and 0W3–9W3 and wiper contacts 42 and 43 will not be employed. As indicated above, switch S1 will be eliminated and lead 51 of wiper contact 41 will be connected directly to leads 59 and 60. Rim 71 of knob 61 will be modified to change its 0 number to 10. When any of numbers 1–10 are dialed through window 73, wiper contact 41 will engage the corresponding contact 0W1–9W1 for connecting either of contacts C30, C1–C9 respectively to female receptacles 1I and 4I.

The quick connect-disconnect apparatus described above is claimed in my copending U.S. patent application filed on the same date as the present application, Ser. No. 030,454, now U.S. Pat. No. 4,284,315, and entitled CHAFF-FLARE TEST ADAPTER CONNECTING AND DISCONNECTING APPARATUS.

What is claimed is:

1. An electrical switch, comprising:

a plurality of first stationary contacts equal to n, wherein n is a number greater than ten, said plurality of stationary contacts being arranged in sets and located in a housing, said contacts of each set being arranged in a circle, each contact of each set representing a decimal digit, a movable contact for each set connected to a first rotatable shaft for sequentially engaging said stationary contacts of its set upon rotation of said first shaft, a plurality of second stationary contacts located in said housing and arranged in a circular line, each of said second stationary contacts representing a decimal digit weighted by a factor of ten, a movable contact means connected to a second rotatable shaft for sequentially engaging said second stationary contacts upon rotation of said second shaft, each movable contact of said sets being electrically connected to one of said second stationary contacts, said first and second rotatable shafts being rotatable relative to each other, a first knob means connected to said first shaft for rotating said first shaft, a plurality of numbers each representing a decimal digit formed on said first knob means and located relative to said first shaft such that when any one of said numbers is aligned with first means of said housing, said movable contact of each set engages a stationary contact representing a corresponding number, a second knob means connected to said second shaft for rotating said second shaft, a plurality of numbers each representing a decimal digit weighted by a factor of ten formed on said second knob means and located relative to said second shaft such that when any one of said numbers formed on said second knob means is aligned with second means of said housing, said movable contact means connected to said second shaft engages one of said second stationary contacts representing a corresponding number and forms an electrical connection between said movable contact means and one of said stationary contacts of said sets of stationary contacts.

2. An adapter for use for testing the operation of an electrically actuated means having a plurality of electrical contacts, the number of said electrical contacts being equal to n, wherein n is greater than ten, comprising:

a base means, an electrical switch comprising:

a plurality of electrical contacts equal to n carried by said base means for engaging said plurality of electrical contacts of said electrically actuated means, a plurality of first stationary contacts equal to n, said plurality of first stationary contacts being arranged in sets of ten and located in a housing, said contacts of each set being arranged in a circle, each contact of each set representing a decimal digit from 0 to 9, a movable contact for each set connected to a first rotatable shaft for sequentially engaging said first stationary contacts of its set upon rotation of said first shaft, a plurality of second stationary contacts located in said housing and arranged in a circular line, each of said second stationary contacts representing a decimal digit weighted by a factor of ten, a movable contact means connected to a second rotatable shaft for sequentially engaging said second stationary contacts upon rotation of said second shaft, each movable contact of said sets being electrically connected to one of said second stationary contacts, said first and second rotatable shafts being rotatable relative to each other, a first knob means connected to said first shaft for rotating said first shaft, a plurality of numbers each representing a decimal digit formed on said first knob means and located relative to said first shaft such that when any one of said numbers is aligned with first means of said housing, said movable contact of each set engages a first stationary contact representing a corresponding number, a second knob means connected to said second shaft for rotating said second shaft, a plurality of numbers each representing a decimal digit weighted by a factor of ten formed on said second knob means and located relative to said second shaft such that when any one of said numbers formed on said second knob means is aligned with second means of said housing, said movable contact means connected to said second shaft engages one of said second stationary contacts representing a corresponding number, each of said contacts of said base means being assigned a decimal number from one to n, each of said contacts of said base means from one to n-1 being electrically connected by way of an electrical lead to one of said first stationary contacts, the stationary contacts of one of said sets representing the decimal 0 having no electrical lead connected thereto, the nth contact of said base means being electrically connected by way of an electrical lead to the contact of said second stationary contacts which represents the largest decimal digit thereof weighted by a factor of ten upon selection of a decimal number by said first and second knobs, the corresponding contact of said base means being electrically connected to said movable contact means.

3. The adapter of claim 2, wherein:

said housing is spaced from said base means, said electrical leads being located in a flexible conduit extending between said base means and said housing.

4. An adapter for use for testing the operation of an electrically actuated means having a plurality of electrical contacts, the number of said electrical contacts being equal to n, comprising:

a base means, a plurality of electrical contacts equal to n carried by said base means for engaging said plurality of electrical contacts of said electrically actuated means, each of said electrical contacts carried by said base means representing a given number, an electrical switch, comprising:

a plurality of stationary contacts equal to n, said plurality of stationary contacts being arranged in a circle and located in a housing, each of said stationary contacts representing a given number, a movable contact connected to a rotatable shaft for sequentially engaging said stationary contacts upon rotation of said shaft, knob means connected to said shaft for rotating said shaft, each of said contacts of said base means being electrically connected by way of an electrical lead to one of said stationary contacts representing a corresponding number, a plurality of numbers formed on said knob means and located relative to said shaft such that when any one of said numbers is aligned with aligning means of said housing, said movable contact engages a stationary contact representing a corresponding number and forms an electrical connection between said movable contact and one of said contacts of said base means.

5. The adapter of claim 4, wherein:

said housing is spaced from said base means, said electrical leads being located in a flexible conduit extending between said base means and said housing.

6. An electrical switch, comprising:

a plurality of stationary contacts equal to n, wherein n is a number greater than ten, said plurality of stationary contacts being arranged in sets, each contact in each set representing a decimal digit, each set of contacts being carried by support structure, a movable contact for each set located to sequentially engage said stationary contacts of its set, first movable means coupled to said movable contacts for moving all of said movable contacts simultaneously for causing said movable contacts to engage a selected one of the stationary contacts of their sets, a plurality of second stationary contacts carried by support structure, each movable contact of said sets being electrically connected to one of said second stationary contacts, a movable contact means located to sequentially engage said second stationary contacts, and second movable means coupled to said movable contact means for moving said movable contact means for causing said movable contact means to engage a selected one of said second stationary contacts for providing an electrical connection between said movable contact means and one of said stationary contacts of said sets of stationary contacts, said first and second movable means being movable relative to each other.

* * * * *